US007536963B2

(12) United States Patent
Durville et al.

(10) Patent No.: US 7,536,963 B2
(45) Date of Patent: May 26, 2009

(54) DEVICE FOR MONITORING THE NEEDLE THREAD

(75) Inventors: Gerard Durville, Gipf-Oberfrick (CH); Niklaus Wacker, Steckborn (CH)

(73) Assignee: Bernina International AG, Steckborn (CH)

( * ) Notice: Subject to any disclaimer, the term of this patent is extended or adjusted under 35 U.S.C. 154(b) by 0 days.

(21) Appl. No.: 11/780,547

(22) Filed: Jul. 20, 2007

(65) Prior Publication Data

US 2008/0022908 A1 Jan. 31, 2008

(30) Foreign Application Priority Data

Jul. 28, 2006 (CH) ..... 1230/06

(51) Int. Cl.
*D05B 51/00* (2006.01)
*D05B 47/00* (2006.01)
*D05B 23/00* (2006.01)

(52) U.S. Cl. ..... 112/302; 112/254

(58) Field of Classification Search ..... 112/302, 112/254, 255, 278, 273; 57/264, 265, 352; 200/61.18; 250/233; 241/412.2, 413, 148
See application file for complete search history.

(56) References Cited

U.S. PATENT DOCUMENTS

| | | | | |
|---|---|---|---|---|
| 3,425,375 | A * | 2/1969 | Wajda et al. | 112/278 |
| 3,785,308 | A * | 1/1974 | Brandriff et al. | 112/278 |
| 4,408,554 | A * | 10/1983 | Takiguchi et al. | 112/302 |
| 4,735,161 | A * | 4/1988 | Brocklehurst | 112/273 |
| 5,199,365 | A * | 4/1993 | Arnold | 112/273 |
| 5,383,417 | A * | 1/1995 | Norrid | 112/278 |
| 6,729,252 | B2 * | 5/2004 | Wada et al. | 112/278 |
| 7,225,747 | B2 * | 6/2007 | Friman et al. | 112/475.01 |

FOREIGN PATENT DOCUMENTS

DE 83897 8/1971

* cited by examiner

*Primary Examiner*—Ismael Izaguirre
(74) *Attorney, Agent, or Firm*—Volpe and Koenig, P.C.

(57) ABSTRACT

A monitoring device (15) for monitoring the needle thread (9) on a sewing machine (1) is provided which includes a regulator spring (25) with at least one cam switch (39) being connected thereto in a rotational manner. In case of changing thread tension and/or thread consumption the cam switch (39) and/or the detection zones (41) embodied thereat passes through a sensor (45) with two sensor areas (a, b). Here, not only the presence and absence of the cam switch (39) can be detected but also a direction of motion and the speed of motion. From these measurements conclusions can be drawn on various parameters of the needle thread (9).

5 Claims, 2 Drawing Sheets

DEVICE FOR MONITORING THE NEEDLE THREAD

CROSS-REFERENCE TO RELATED APPLICATIONS

This application claims the benefit of Swiss Appln. No. 01230/06, filed Jul. 28, 2006.

BACKGROUND

The invention is directed to a device for monitoring the needle thread in a sewing machine.

Devices of said type are known and serve to monitor yarn breakage during sewing. They detect if the needle thread has been correctly threaded in the sewing machine, in particular in automatic threading devices.

From the GDR-publication 83897 a device for monitoring the needle thread is known, in which the needle thread running from the thread tension device to the thread lever is deflected at a regulator spring. A cam switch is connected to the regulator spring, which in case of changing thread tensions glides through a light bar and in case of an insufficient tension, e.g., caused by yarn breakage, triggers a signal. In this known device, in case of detection, there is only the possibility to detect yarn breakage or, to a limited extent, excess change of thread tension. No other detailed data regarding the functions of the sewing machine can be detected.

SUMMARY

One object of the present invention is to provide a device for the general monitoring of the needle thread, by which changes of the thread tension as well as the thread motion can be detected both in the negative as well as in the positive sense and conclusions can be drawn for the functions of various elements of the sewing machine.

This object is attained in a device according to the invention. Advantageous embodiments of the invention are described in detail below.

Using the device according to the invention it is possible to detect exact data concerning the thread tension as well as changes of the thread motion in both directions and by evaluating the results to draw conclusions during the sewing process for the adjustment of the thread tension device, sewing errors, such as thread balls, skip stitches, failed stitch formation, etc., but also for the influence of the material thickness, stitch length, changes of thread consumption per stitch and thread quality. Further, conclusions can also be drawn on the function of the thread lever motion, the material thickness, stitch length, and thread quality. Additionally a service mechanic can review the default settings.

BRIEF DESCRIPTION OF THE DRAWINGS

The invention is explained in greater detail using an illustrated exemplary embodiment. Shown are.

DETAILED DESCRIPTION OF THE PREFERRED EMBODIMENTS

Figure 1:
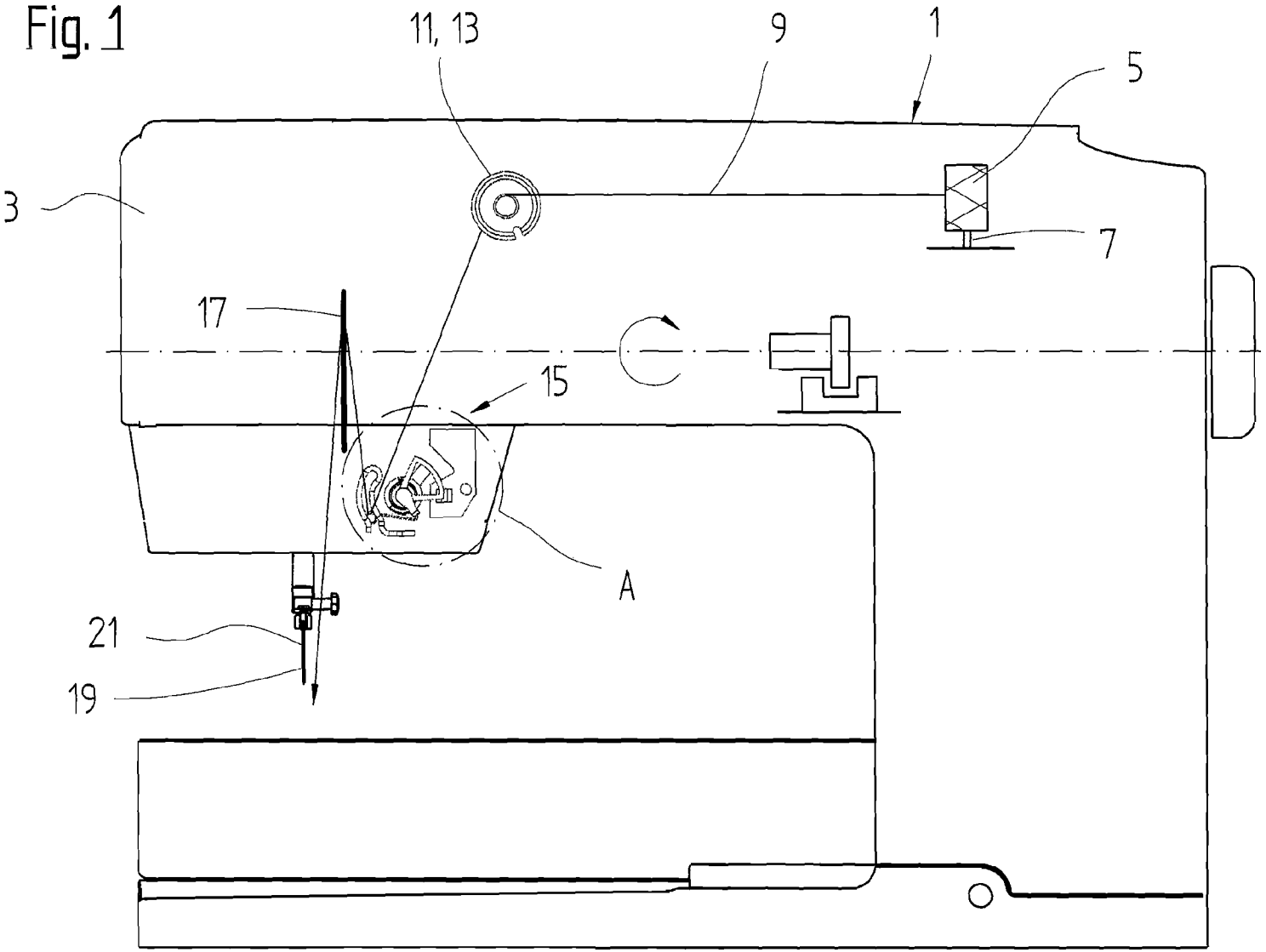
FIG. 1 is a schematic view of the upper arm of a sewing machine.

Reference character 1 references the outline of a household sewing machine. On the sewing machine 1 only the essential parts for understanding the invention are shown. In the upper arm 3 there is a needle thread bobbin 5 rotatably positioned on a bobbin mandrel 7. The needle thread 9 directly or indirectly leads from the needle thread bobbin 5 to a thread tension device 11 of conventional design, for example, comprising two discs 13 compressible by an axially effective spring, between which the needle thread 9 is guided through. From here, the thread 9 runs into a monitoring device, device 15 for short, for monitoring the needle thread 9. The device 15, which is the object of the invention, is explained in greater detail using FIG. 2, which shows an enlargement of the area A in FIG. 1.

From the device 15, the thread 9 further extends to the thread lever 17 and from there, after being suitably deflected, to the eye 19 of the needle 21.

In the enlarged representation of the device 15 for the needle thread 9, a regulator spring 25 is unilaterally held in a rotation-proof manner at a mounting plate 2, which may be a component of the housing of the sewing machine 1. The regulator spring 25 comprises a helically bent section 27 as well as a leg 28 tangentially facing away from the section 27. The free end 31 of the leg 29 of the regulator spring 25, embodied as a thread deflector, is preferably laterally guided in a guidance device 33. The guidance device 33 may comprise two parallel extending plates or wires 35, which ensure the lateral inlet and outlet of the needle thread 9. The helically shaped section 27 of the regulator spring 25 encompasses a shaft stump 37, on which a cam switch 39 in the form of a circular segment is pivotally supported. The cam switch 39 is connected in a fixed manner to the leg 29 and follows its oscillations during changes of thread tension and/or thread motion. The changes of thread tension and thread motion may for example be caused by a change of the thread consumption per stitch. On the periphery of the cam switch 39 light/dark or black/white areas (not shown) and/or protrusions 41 having a meandering contour or other detectable areas are arranged. These areas/protrusions 41 are embodied on a cylinder casing segment 43, axially protruding from the level of the cam switch 39. The cylinder segment 43 passes, in a pivotal motion of the cam switch 39, through a sensor 45, in which two or more serially arranged sensor areas a, b, c, are inserted. Light bars, proximity switches, or the like can be used as sensors and/or sensor areas, by which the presence of the cam switch 39, its present location and/or its present pivotal angle as well as its direction of motion and/or the speed of motion can be exactly detected.

Figure 2:
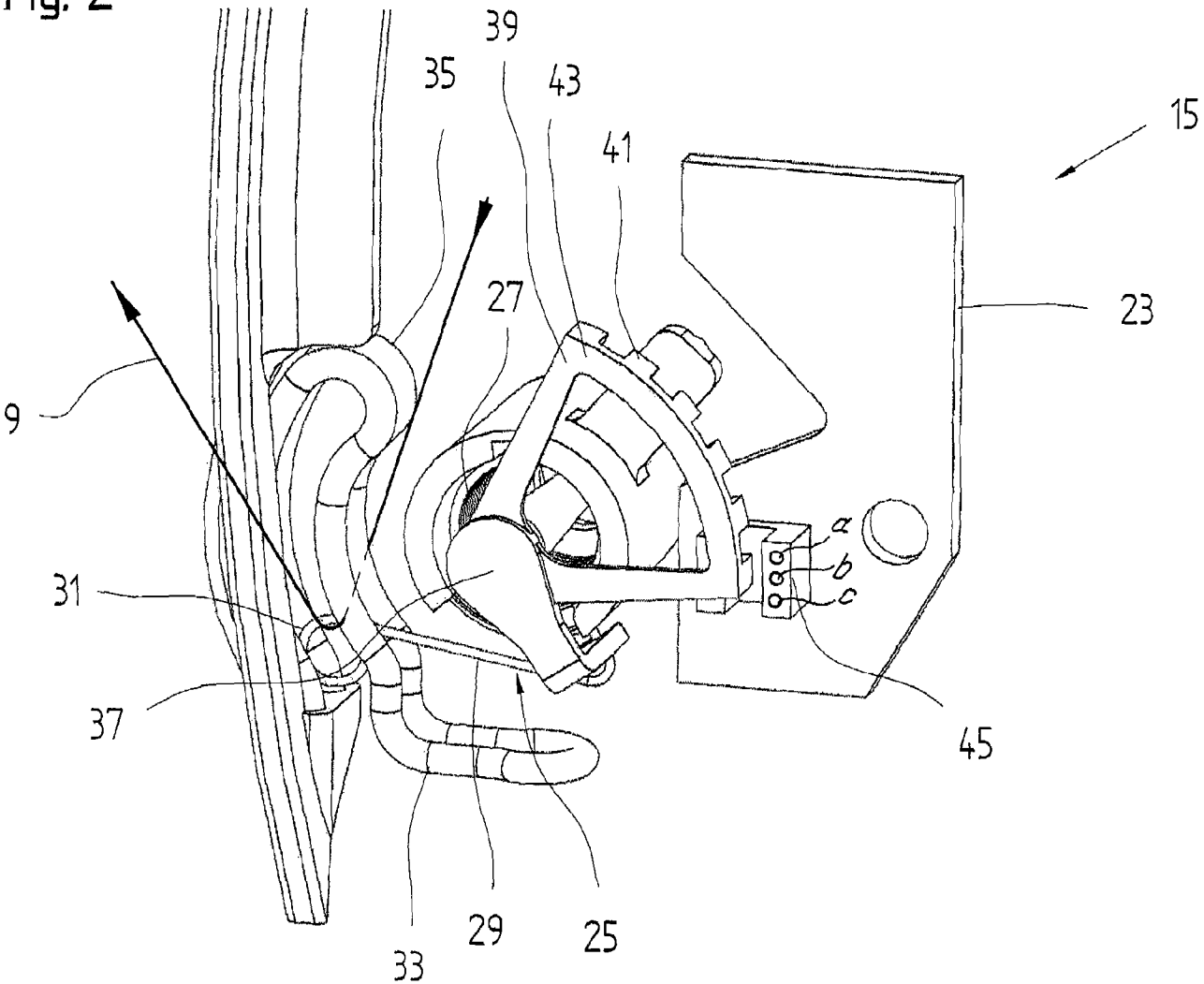
FIG. 2 is an enlarged perspective representation of the section A in FIG. 1.

In the following, the operation of the device 15 is explained. By the changes of thread tension and/or thread motion as well as changes of the thread consumption of the needle thread 9, guided through the hook-shaped end 31 of the regulator spring 25, the regulator spring 25 in FIG. 2 is moved in the clockwise direction in case the thread tension increases and in the counter-clockwise direction when the thread tension drops. Depending on the extent of the change of thread tension and/or thread consumption the cam switch 39 is more or less pivoted with various speeds and the protrusions or light/dark areas 41 are passed between the elements of the sensors 45. By the distribution of the cylinder segments 43 of the cam switch 39 in the light/dark areas, which may also be caused by protrusions and/or notches, and at least two serially switched sensor areas a, b, the direction of motion (direction of rotation) of the cam shaft 39, its rotation, and its rotary angle can be detected. Alternatively, parallel arranged sensor areas may be provided, if the light/dark areas 41 are arranged radially off-set on the cam switch 39 (not shown). This way the desired conclusions on the extent of the change of tension and/or thread consumption of the needle thread 9 can be drawn as well as on the temporal occurrence within an individual sewing cycle/stitch formation (frequency) and the type of changes of the thread tension and the thread consumption can be detected and evaluated. The detected values may then be further used, for example, for correcting (readjusting) the thread breakage (thread tension device 11) and additional adjustment parameters at the sewing machine 1.

Summarizing, conclusions can be drawn, for example, regarding

- sewing errors (thread balls, skip stitches, failed stitch formation, etc.)
- material thickness
- stitch length
- thread quality
- etc.

LIST OF REFERENCE CHARACTERS

1 sewing machine
3 upper arm
5 needle thread bobbin
7 bobbin mandrel
9 needle thread
11 thread tension device
13 disks
15 device for monitoring the needle thread
17 thread lever
19 eye
21 needle
23 fastening plate
25 regulator spring
27 helical section
29 leg of 25
31 end of 25
33 guidance device
35 plates/wires
37 shaft stump
39 cam switch
41 protrusions
43 cylinder segment
45 sensor

The invention claimed is:

1. A device (15) for monitoring breakage and changes in tension of a needle thread (9) on a sewing machine (1), comprising a thread regulator with a regulator spring (25), a cam switch (39) effectively connected to the regulator spring (25), which is inserted between a thread lever (17) and a thread tension device (11), a sensor (45) for monitoring at least one of a presence or absence of the cam switch (39) at the sensor (45), the cam switch (39) comprises at least two detection zones (41) and the sensor (45) includes at least two independent switched detection areas (a, b).

2. A device according to claim 1, wherein the cam switch (39) is pivotal on a shaft stump (39) and comprises an arc-segment shaped body, with the detection zones (41) being provided in a peripheral area thereof.

3. A device according to claim 2, wherein the detection zones are at least one of light/dark areas, recesses, or protrusions (41).

4. A device according to claim 1, wherein the sensor (45) comprises at least two parallel located light bars (a, b) or proximity switches as a detection means.

5. A device according to claim 4, wherein the detection means are arranged in a parallel or serial fashion.

* * * * *